US008390406B2

(12) United States Patent
An

(10) Patent No.: US 8,390,406 B2
(45) Date of Patent: Mar. 5, 2013

(54) MOLD CASED CIRCUIT BREAKER

(75) Inventor: Young Gyu An, Chungcheongbuk-Do (KR)

(73) Assignee: LSIS Co., Ltd., Anyang, Gyeonggi-Do (KR)

( * ) Notice: Subject to any disclaimer, the term of this patent is extended or adjusted under 35 U.S.C. 154(b) by 0 days.

(21) Appl. No.: 13/115,895

(22) Filed: May 25, 2011

(65) Prior Publication Data

US 2011/0297649 A1 Dec. 8, 2011

(30) Foreign Application Priority Data

Jun. 4, 2010 (KR) ..... 10-2010-0053065

(51) Int. Cl.
*H01H 75/12* (2006.01)

(52) U.S. Cl. ..... 335/35; 335/157; 218/35

(58) Field of Classification Search ..... 335/35, 335/202; 218/157
See application file for complete search history.

(56) References Cited

U.S. PATENT DOCUMENTS 4,965,544 A * 10/1990 Kelaita et al. ..... 335/202
5,304,761 A * 4/1994 Rosen et al. ..... 218/157
6,144,540 A * 11/2000 Arnold et al. ..... 361/93.9
6,288,621 B1 9/2001 Rival
6,801,110 B2 * 10/2004 Kolberg et al. ..... 335/35
7,362,207 B2 * 4/2008 Malingowski et al. ..... 337/206
8,138,439 B2 * 3/2012 Malingowski et al. ..... 218/35
2001/0007318 A1 7/2001 Rival et al.
2007/0075045 A1 4/2007 Kuhrt et al.
2007/0131526 A1 6/2007 Jones et al.

FOREIGN PATENT DOCUMENTS

JP 2001216881 8/2001
JP 2007115540 5/2007

OTHER PUBLICATIONS

Japanese Patent Office Application Serial No. 2011-124603, Office Action dated Nov. 27, 2012, 5 pages.

* cited by examiner

*Primary Examiner* — Truc Nguyen
(74) *Attorney, Agent, or Firm* — Lee, Hong, Degerman, Kang & Waimey

(57) ABSTRACT

A mold cased circuit breaker, which includes a casing, a switching unit disposed in the casing to open or close an electric circuit, and movable and stationary contactor units present within the casing, includes an arc-extinguishing unit. The arc-extinguishing unit includes a pair of side plates facing each other with being spaced from each other, at least one first grid arranged between the side plates and spaced apart from one another with preset intervals, and a second grid coupled to upper ends of the side plates, spaced apart from the first grid, and having a bent portion with a preset angle.

6 Claims, 4 Drawing Sheets

MOLD CASED CIRCUIT BREAKER

CROSS-REFERENCE TO RELATED APPLICATION

Pursuant to 35 U.S.C. §119(a), this application claims the benefit of earlier filing date and right of priority to Korean Application No. 10-2010-0053065, filed on Jun. 4, 2010, the contents of which is incorporated by reference herein in its entirety.

BACKGROUND OF THE INVENTION

1. Field of the Invention

This specification relates to a mold cased circuit breaker capable of fast extinguishing arc, which is generated when a movable contactor is separated from a stationary contactor due to a fault current, by segmenting and cooling the generated arc and discharging arc pressure to the outside.

2. Background of the Invention

Generally, a mold cased circuit breaker is an electric protection apparatus, which is installed in an electric circuit to protect the circuit by preventing or minimizing damages on load equipment and lines due to fault currents (e.g., overload, short-circuit, etc.).

The circuit breaker typically includes a movable contactor, a stationary contactor, an arc-extinguishing device and the like. Upon occurrence of a fault current, the movable contactor is separated from the stationary contactor to trip a circuit and the circuit is protected accordingly. Here, when the movable contactor is separated from the stationary contactor, dielectric insulation in air is caused due to a current, thereby generating hot plasma arc state. Furthermore, gas is generated and accordingly arc pressure is generated. The thusly generated arc is segmented and cooled to be discharged outside, and a device performing such function is an arc-extinguishing device or an arc chamber.

The arc-extinguishing device generally has a structure that a plurality of grids are arranged in parallel. The grids absorb arc generated during tripping, thereby extinguishing the arc. Besides, various debris generated due to adjacent components being melted are adhered onto the grids, thus to reduce pressure within the circuit breaker, decrease erroneous operations of the circuit breaker, and increase an interruption capability.

FIG. 1 shows a type of a mold cased circuit breaker according to the related art. As shown in FIG. 1, the mold cased circuit breaker includes a main body having a front base 10, a rear base 20 and a cover 30 all for insulation from the exterior, a movable contactor 50, a stationary contactor 60, an arc-extinguishing unit 70, a switching mechanism 40 for mechanically switching a circuit on or off and the like.

FIG. 2 shows the related art arc-extinguishing unit 70 in more detail. As shown in FIG. 2, the arc-extinguishing unit 70, which is typically called an arc chamber, includes a pair of side plates 71, and grids 72 arranged in parallel within a space between the side plates with preset intervals. The arc-extinguishing unit 70 is positioned within the main body of the mold cased circuit breaker.

FIG. 2 shows a state that the movable contactor is separated from the stationary contactor. As shown in FIG. 2, the arc-extinguishing unit 70 is present in the space formed within the main body of the circuit breaker. The movable contactor 50 is rotated by the switching mechanism 40 to be separated from the stationary contactor 60. The movable contactor 50 then moves along a plurality of grids arranged in the arc-extinguishing unit 70 so as to extinguish arc. Debris generated during the separation is adhered on the grids of the arc-extinguishing unit 70 or the like.

However, such debris may be adhered on the movable contactor 50 or the stationary contactor 60 without entirely being adhered on the grids. Furthermore, the debris may be spread into the main body of the circuit breaker to thereby affect other components of the circuit breaker including the switching mechanism 40. The affection by the debris may cause an erroneous operation of the switching mechanism 40 of the circuit or interrupt the circuit, thereby lowering characteristics of the circuit.

Therefore, to improve the performance of the mold cased circuit breaker, a technique for effectively adhering such debris within the arc-extinguishing unit should be considered.

SUMMARY OF THE INVENTION

Therefore, an aspect of the detailed description is to provide an arc-extinguishing unit for a mold cased circuit breaker capable of preventing debris generated due to arc from being spread in the mold cased circuit breaker and adhering the debris on grids as much as possible.

Another aspect of the detailed description is to provide a mold cased circuit breaker capable of smoothly exhausting arc by increasing a space of the arc-extinguishing unit in a manner of allowing an interval between a grid and a movable contactor to be as wide as possible within an arc-inducible range, whereby erroneous operations of the mold cased circuit breaker can be reduced and an interruption capability of the mold cased circuit breaker can be improved.

To achieve these and other advantages and in accordance with the purpose of this specification, as embodied and broadly described herein, there is provided a mold cased circuit breaker having a casing, a switching unit disposed in the casing to open or close an electric circuit, and movable and stationary contactor units present within the casing, the circuit breaker including an arc-extinguishing unit, wherein the arc-extinguishing unit includes a pair of side plates facing each other with being spaced from each other, at least one first grid arranged between the side plates and spaced apart from one another with preset intervals, and a second grid coupled to upper ends of the side plates, spaced apart from the first grid, and having a bent portion with a preset angle.

Here, the casing may include an accommodating part configured to accommodate the arc-extinguishing unit therein, and a barrier defining a part of an outer wall of the accommodating part and protruding toward the arc-extinguishing unit, and one side surface of the second grid may be contactable with the barrier.

The barrier may include a contact part protruding with being stepped to have an inclination, and the contact part and the second grid may contact each other.

The second grid may include a horizontal part and a blocking part extending from the horizontal part by being bent from the horizontal part, and the horizontal part may contact the contact part. In addition, the horizontal part and the blocking part may form at least an acute angle.

Also, the second grid may be bent in an opposite direction to the movable contactor unit to form at least an acute angle.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
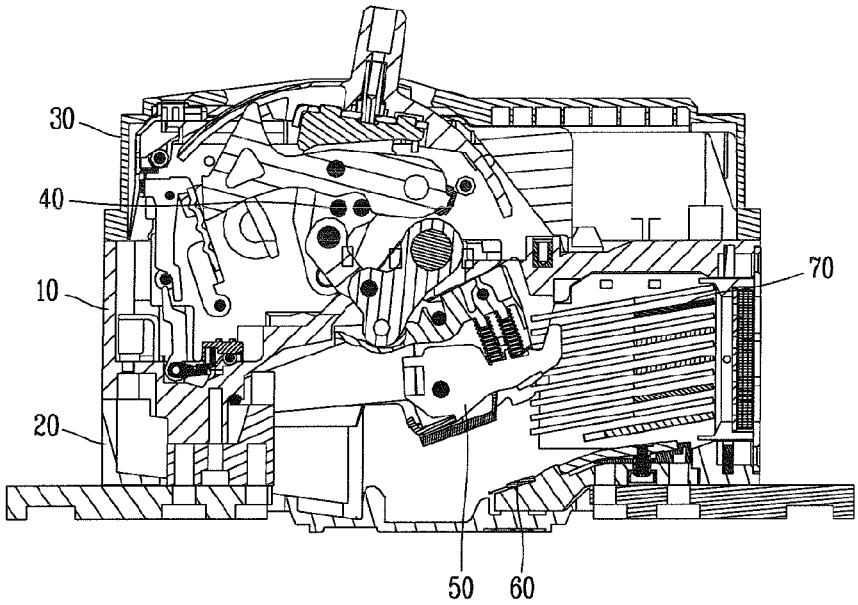
FIG. 1 PRIOR ART
FIG. 1 is a side sectional view of a mold cased circuit breaker according to the related art.
Figure 2:
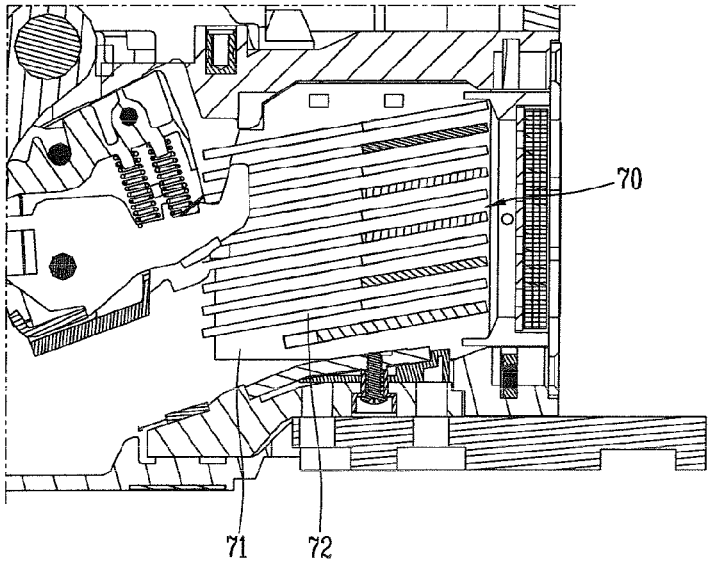
FIG. 2 PRIOR ART
FIG. 2 is an enlarged view of an arc-extinguishing unit of FIG. 1.
Figure 3:
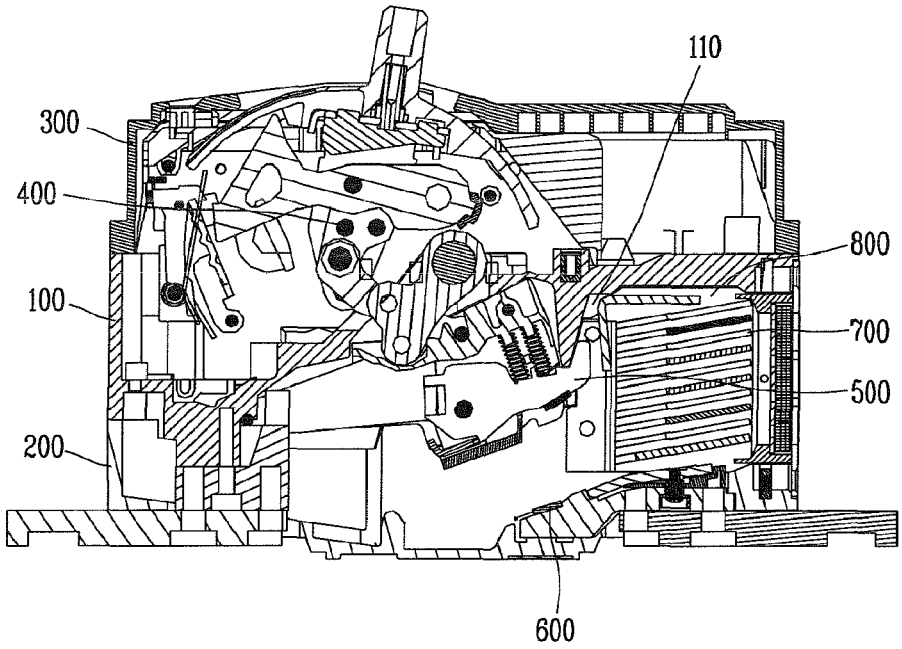
FIG. 3 is a side sectional view of a mold cased circuit breaker in accordance with this specification.
Figure 4:
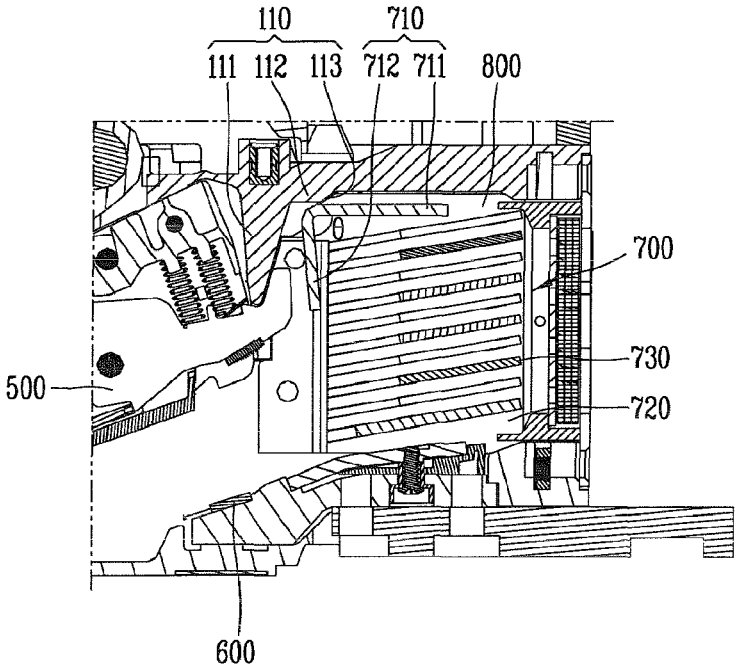
FIG. 4 is an enlarged view of an arc-extinguishing unit (after separation) of FIG. 3.
Figure 5:
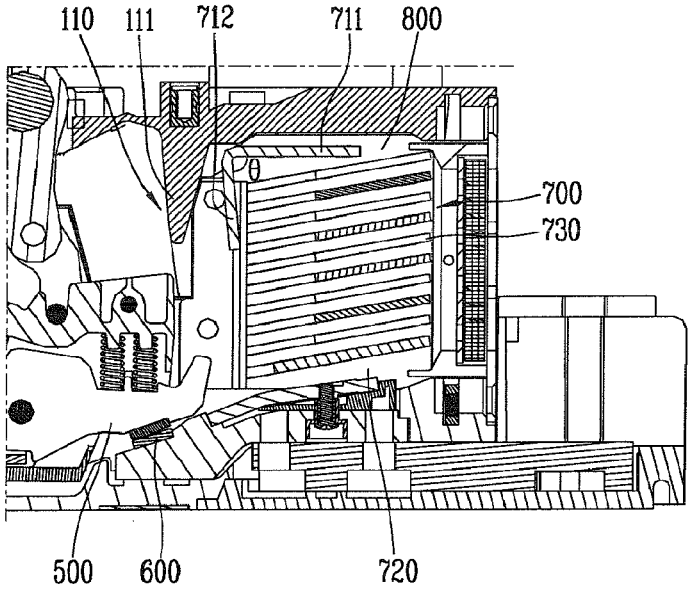
FIG. 5 is an enlarged view of the arc-extinguishing unit (before separation) of FIG. 3.
Figure 6:
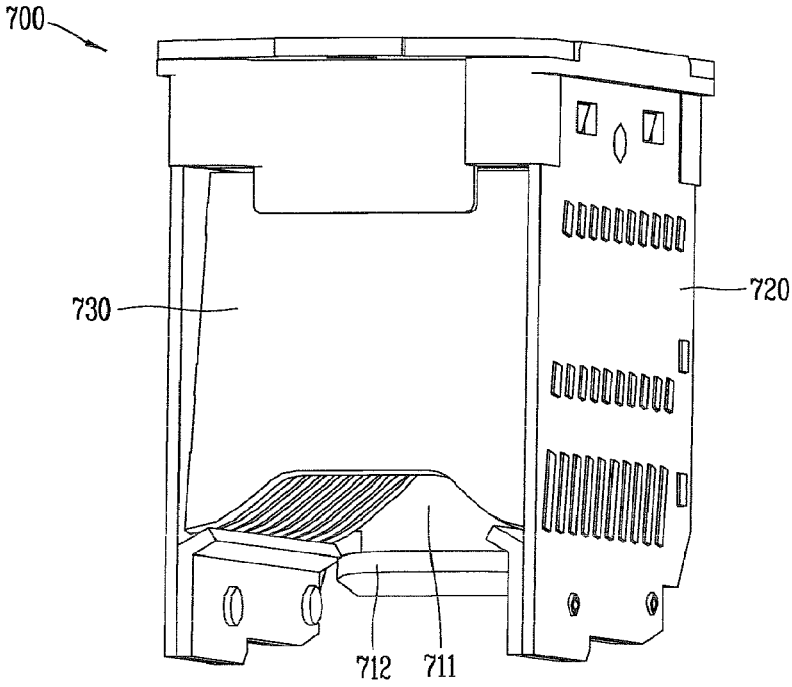
FIG. 6 is a view showing a lower surface of the arc-extinguishing unit.
Figure 7:
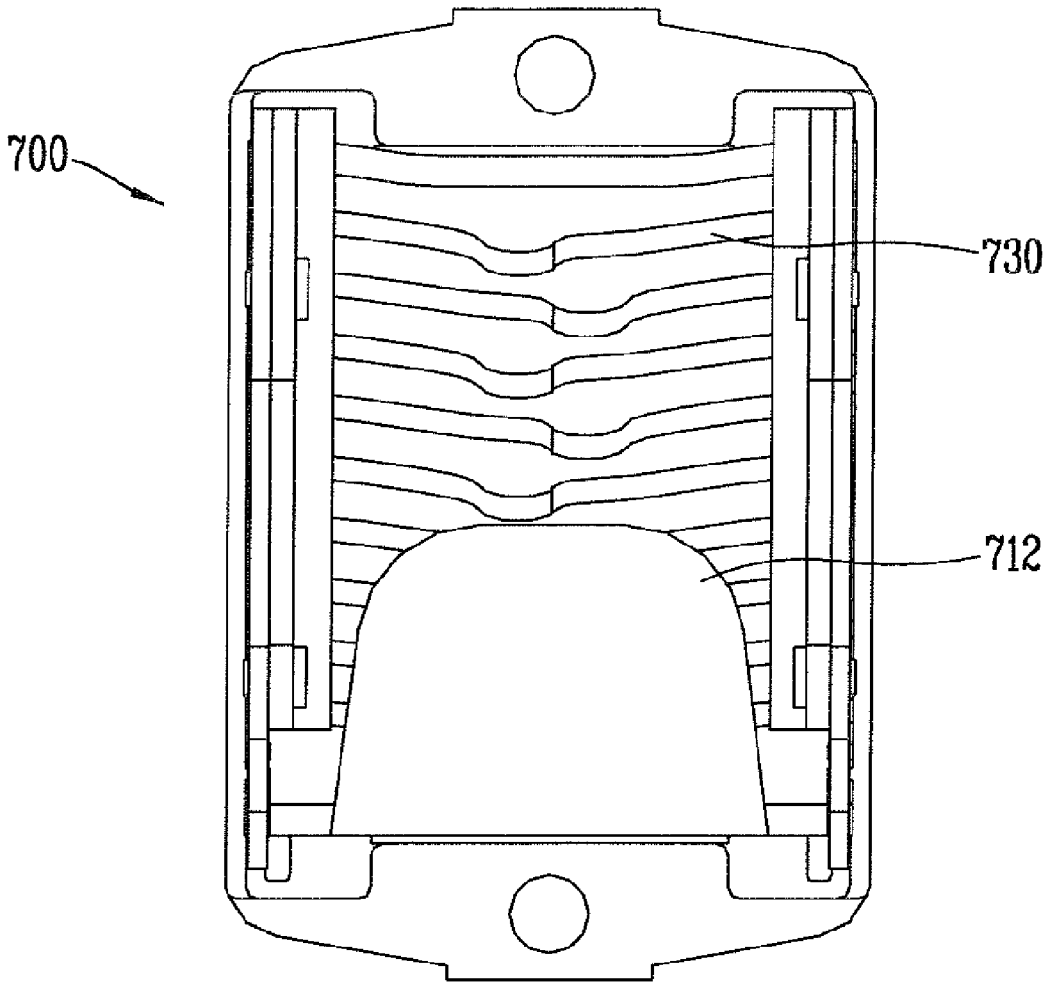
FIG. 7 is a front view of the arc-extinguishing unit of FIG. 6 shown in an upside down state.

FIG. 3 is a side sectional view of a mold cased circuit breaker in accordance with this specification, FIG. 4 is an enlarged view of an arc-extinguishing unit (after separation) of FIG. 3, FIG. 5 is an enlarged view of the arc-extinguishing unit (before separation) of FIG. 3, FIG. 6 is a view showing a lower surface of the arc-extinguishing unit, and FIG. 7 is a front view of the arc-extinguishing unit of FIG. 6 shown in an upside down state.

As shown in FIG. 3, a mold cased circuit breaker according to this specification may include a casing for accommodating components therein and allowing insulation from the exterior, a switching mechanism 400 disposed in the casing for switching an electric circuit on or off, and a movable contactor unit 500 and a stationary contactor unit 600 both disposed in the casing.

The casing, as shown in FIG. 3, may include a front base 100, a rear base 200 and a cover 300, by which both an enclosure of the mold cased circuit breaker and an inner space for accommodating the components are defined. Also, the front base 100, the rear base 200 and the cover 300 may be molded with an insulating material so as to allow insulation between inside and outside of the casing. This structure is commonly known, so detailed description thereof will be omitted.

Referring to FIG. 4, the casing may include an accommodating part 800 in which an arc-extinguishing unit to be explained later is present, and a barrier 110 defining a part of an outer wall of the accommodating part 800 and protruding toward the arc-extinguishing unit.

Still referring to FIG. 4, the barrier 110 may include a limit part 111 for setting a limit of a movement of the movable contactor unit 500, and a contact part 112 protruding with being stepped from the limit part 111 to have an inclination 113. The contact part 112 may contact a second grid which will be explained later.

The limit part 111 may protrude into the casing. The limit part 111 may allow the space for accommodating the arc-extinguishing unit to be further blocked from a space for accommodating the switching mechanism 400, thereby eventually minimizing or preventing spreading of debris.

The contact part 112 and the second grid may contact each other to block the space for accommodating the movable contactor unit 500 and the switching mechanism 400 from the upper portion of the accommodating unit 800. Accordingly, debris, which are generated upon extinguishing arc, can be adhered within the accommodating unit 800 as much as possible. Also, the second grid and the contact part 112 may contact each other at a position the most approached to the barrier 110, thereby increasing the inner space of the accommodating unit 800. Consequently, an interval between the grid and the movable contactor unit 500 may be defined as long as possible within an arc-inducible range and the space for the arc-extinguishing unit may be increased. Therefore, arc extinguishing can be carried out smoothly, thereby reducing mal-operations of the mold cased circuit breaker and improving interruption capability.

The switching mechanism 400 may include a handle, a spring, a latch and the like, and serve to mechanically operate the movable contactor unit 500. This structure is frequently used in the typical mold cased circuit breaker and thus will not be described in detail.

The movable contactor unit 500 may be operated by the switching mechanism 400, and include a movable contactor at its end. The movable contactor may be coupled to the movable contactor unit 500 by an adhesive agent or by a typical coupling member to thusly move integrally with the movable contactor unit 500. In general, the movable contactor has one end electrically connected to an output terminal side of a circuit and the other end contacting a stationary contactor, which is electrically connected to an input terminal side of the circuit, thereby allowing an electric short of the circuit.

The stationary contactor unit 600, as aforementioned, may include the stationary contactor electrically connected to the input terminal side, and, as shown in FIGS. 3 to 5, be fixed to the casing.

Referring to FIGS. 3 and 4, the mold cased circuit breaker may include an arc-extinguishing unit 700. Especially, the arc-extinguishing unit 700 may include a pair of side plates 720 facing each other by being spaced apart from each other, at least one first grid 730 arranged between the side plates and spaced from one another with preset intervals there between, and a second grid 710 coupled to upper ends of the side plates 720, spaced apart from the first grid 730 and having a bent portion with a preset angle θ.

The pair of side plates 720 may have a structure of supporting the arc-extinguishing unit 700, and allow the arc-extinguishing unit 700 to be stably accommodated in the accommodating part 800 of the casing. As shown in FIG. 6 as one exemplary embodiment, the side plates 720 may be in a rectangular form and face each other with being spaced from each other. It may be noticed that end portions of the side plates 720 are supported by structures (reference numeral not given) for maintaining the spaced state.

Referring to FIGS. 6 and 7, the first grid 730 may have a structure that a plurality of grids, namely, insulating plates are arranged in parallel. Each insulating plate configuring the first grids 730 may be in form of a rectangular plate, and have one end portion recessed toward the movable contactor unit 500, thereby forming an extra space for allowing the movable contactor unit 500 to be rotatable upon a trip operation. However, if the space is excessively large, arc may not be stably induced to the insulating plates. Therefore, the second grid 710 may be needed.

Referring to FIGS. 4 to 7, the second grid 710 may include a horizontal part 711, and a blocking part 712 extending from the horizontal part 711 in a bent state. One side surface of the second grid 710 may contact the barrier 110. More particularly, the horizontal part 711 contacts the contact part 112 of the barrier 110. This contact structure has been aforementioned, so detailed description will be omitted.

Referring back to FIG. 4, the blocking part 712 may extend from the horizontal part 711 by being bent away from the movable contact unit 500 such that the bent angle is at least an acute angle θ. That is, the blocking part 712 may face the inner side of the arc-extinguishing unit 700, by which debris generated upon extinguishing arc may be adhered as much as possible within the accommodation part 800. Also, such structure may allow the inner space of the accommodating part 800 to be as large as possible, thereby enabling the second grid 710 and the movable contactor 500 to have the farthest distance there between within an arc-inducible range and increasing the space for the arc-extinguishing unit 700. Accordingly, arc extinguishing can be carried out smoothly, resulting in reduction of erroneous operations of the mold cased circuit breaker and improvement of an interruption capability of the mold cased circuit breaker. In addition, an extra space sufficient to make the movable contactor unit 500 rotatable upon a trip operation can be formed, thereby allowing arc to be stably induced onto the insulating plates.

With the structure having the first grids 730 and the second grid 710, the plurality of grids can absorb arc generated during the trip operation so as to extinguish such arc. In addition, various types of debris generated due to melting of the adjacent components to the arc-extinguishing unit 700 can be adhered on the grids as much as possible, thereby reducing pressure within the mold cased circuit breaker, which results in reduction of erroneous operations of the mold cased circuit breaker and improvement of an interruption capability thereof.

Hereinafter, description will be given of operations of the mold cased circuit breaker having the configuration according to one exemplary embodiment with reference to the accompanying drawings.

In a normal state of the mold cased circuit breaker, the arc-extinguishing unit 700 is in a state shown in FIG. 5. Here, the movable contactor and the stationary contactor are in a contact state, so a circuit is in an electrically connected state.

When a fault current (e.g., overload, short-circuit, etc.) flows on the circuit, the movable contactor rotates in a counterclockwise direction in the drawing by the operation of the switching mechanism 400 so as to be in the state of FIG. 3 or 4. Here, arc in a hot plasma state is generated between the movable contactor and the stationary contactor due to dielectric breakdown in the air.

The arc, which is continuously generated in response to the rotation of the movable contactor, is gradually extinguished by the first grids 730 and the second grid 710. Also, debris generated during the arc extinguishing are adhered on the first grids 730 and the second grid 710. Especially, the second grid 710 is positioned more adjacent to the movable contactor unit 500 than the first grids 730. Accordingly, the second grid 710 induces more arc so as to more easily extinguish the arc. Also, a distance between the first grids 730 and the movable contactor unit 500 becomes sufficient to form an extra space more in the arc-extinguishing unit 700.

In addition, since the second grid 710 is located more adjacent to the movable contactor unit 500 than the first grids 730 and bent with forming an acute angle, the debris generated within the arc-extinguishing unit 700 may eventually be blocked by the second grid 710, thereby efficiently preventing the debris from being spread into the mold cased circuit breaker, which will be noticed more obviously with reference to FIG. 4.

This specification can provided the following effects by virtue of the configuration of the mold cased circuit breaker.

The second grid, which is bent away from the movable contactor unit to form a preset angle, may be provided and one side surface of the second grid may be contactable with the barrier, thereby minimizing debris generated due to arc from being spread into the mold cased circuit breaker and allowing such debris to be adhered onto the grids as much as possible.

Also, the second grid, which is bent away from the movable contactor unit to form a preset angle, may be provided, thereby ensuring the farthest distance between the second grid and the movable contactor unit within an arc-inducible range, resulting in an increase in a space of the arc-extinguishing unit.

Consequently, arc can be smoothly extinguished, which results in reduction of erroneous operations of the mold cased circuit breaker and improvement of an interruption capability thereof.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A mold cased circuit breaker comprising:

a casing;

a switching unit located in the casing and configured to open or close an electric circuit;

movable and stationary contactor units located within the casing;

an arc-extinguishing unit, wherein the arc-extinguishing unit comprises:

a pair of side plates facing each other and spaced apart from each other;

at least two first grids arranged between the pair of side plates and spaced apart from each other at preset intervals; and a second grid coupled to upper ends of the pair of side plates, spaced apart from the first grids and comprising a bent portion with a preset angle, wherein the casing comprises an accommodating portion configured to accommodate the arc-extinguishing unit therein and a barrier defining a portion of an outer wall of the accommodating portion, the barrier protruding toward the arc-extinguishing unit, and wherein one side surface of the second grid is configured to contact the barrier.

2. The circuit breaker of claim 1, wherein:

the barrier comprises a protruding contact portion that is stepped such that it has an inclination; and the contact portion and the second grid contact each other.

3. The circuit breaker of claim 1, wherein the second grid is bent away from the movable contactor unit to form at least an acute angle.

4. The circuit breaker of claim 2, wherein:

the second grid further comprises a horizontal portion and a blocking portion, the blocking portion bent from the horizontal portion such that it extends from the horizontal portion; and wherein the horizontal portion contacts the contact portion.

5. The circuit breaker of claim 4, wherein the horizontal portion and the blocking portion form at least an acute angle.

6. The circuit breaker of claim 2, wherein the second grid is bent away from the movable contactor unit to form at least an acute angle.

* * * * *